US010932980B2

(12) United States Patent
Koskela

(10) Patent No.: US 10,932,980 B2
(45) Date of Patent: Mar. 2, 2021

(54) DEVICE AND METHOD FOR FOOT EXERCISE

(71) Applicant: VQ INNOVATION, Stockholm (SE)

(72) Inventor: Vesa Koskela, Stockholm (SE)

(73) Assignee: VQ INNOVATION, Stockholm (SE)

( * ) Notice: Subject to any disclaimer, the term of this patent is extended or adjusted under 35 U.S.C. 154(b) by 514 days.

(21) Appl. No.: 15/765,744

(22) PCT Filed: Oct. 9, 2016

(86) PCT No.: PCT/SE2016/050973

§ 371 (c)(1),
(2) Date: Apr. 4, 2018

(87) PCT Pub. No.: WO2017/061949

PCT Pub. Date: Apr. 13, 2017

(65) Prior Publication Data

US 2019/0091090 A1 Mar. 28, 2019

(30) Foreign Application Priority Data

Oct. 9, 2015 (SE) ..... 1530153-4

(51) Int. Cl.
*A61H 1/02* (2006.01)

(52) U.S. Cl.
CPC ..... *A61H 1/0266* (2013.01); *A61H 2001/027* (2013.01); *A61H 2201/0192* (2013.01);
(Continued)

(58) Field of Classification Search
CPC ..... A63B 2023/006; A61H 1/0266; A61H 2001/027; A61H 2201/1269;
(Continued)

(56) References Cited

U.S. PATENT DOCUMENTS 1,546,506 A 7/1925 Naysmith
2,016,930 A 10/1935 McCahan et al.
(Continued)

FOREIGN PATENT DOCUMENTS

FR 2782648 A1 3/2003
WO 2008026981 A1 3/2008
WO 2015070315 A1 5/2015

OTHER PUBLICATIONS

International Search Report, Application No. PCT/SE2016/050973, dated Jan. 18, 2017, 4 pages.

*Primary Examiner* — Michael J Tsai
(74) *Attorney, Agent, or Firm* — Ziegler IP Law Group, LLC

(57) ABSTRACT

There is provided a foot exercising device and method of exercising a foot using the device. The foot exercising device includes a foot support, a lift wedge, and a tilting arrangement. The foot support includes an elevated footrest to support a foot of a person thereon and a platform, having an extensive floor-contact area when in operation, coupled to the elevated footrest for supporting the elevated footrest on a floor. The lift wedge to be arranged on the elevated footrest is operable to receive the toes thereon. The tilting arrangement includes a pair of spaced apart fixed plates coupled to the elevated footrest, a pair of spaced apart movable plates hingedly coupled to the fixed plates, a centre plate arranged between the pair of spaced apart movable plates, and a rod pivotally coupled to the centre plate to exert pressure on at least the heel, the middle foot bones and the toes to perform foot correction exercises.

14 Claims, 5 Drawing Sheets

(52) U.S. Cl.
CPC ..... *A61H 2201/1269* (2013.01); *A61H 2201/164* (2013.01); *A61H 2201/1676* (2013.01); *A61H 2205/12* (2013.01)

(58) Field of Classification Search
CPC ..... A61H 2201/164; A61H 2201/1642; A61H 2205/12
See application file for complete search history.

(56) References Cited

U.S. PATENT DOCUMENTS

| | | | | | |
|---|---|---|---|---|---|
| 4,474,176 | A * | 10/1984 | Farris | A61H 1/0266 | 601/27 |
| 5,611,770 | A * | 3/1997 | Tesch | A61H 1/0266 | 482/131 |
| 6,110,078 | A * | 8/2000 | Dyer | A61H 1/0266 | 482/121 |
| 2002/0183664 | A1 | 12/2002 | Lu et al. | | |
| 2008/0051682 | A1* | 2/2008 | Thomas | A61H 1/0266 | 601/23 |
| 2010/0234195 | A1* | 9/2010 | Koskela | A63B 23/04 | 482/142 |
| 2014/0336012 | A1 | 11/2014 | Gourineni | | |
| 2015/0126911 | A1* | 5/2015 | Abramowicz | A61H 1/00 | 601/5 |

* cited by examiner

DEVICE AND METHOD FOR FOOT EXERCISE

TECHNICAL FIELD

The present disclosure relates generally to an exercising device; and more specifically, to a device and a method of foot exercise. The device and method according to the present invention can be used to advantage in both training and therapy.

BACKGROUND

A variety of foot deformities and symptoms (such as wrong positioning of bones, muscles and so forth) may exist in a foot of a person. Such foot deformities may be congenital or acquired, or both congenital and acquired. In an example, commonly known foot deformities include Achilles tendonitis, Flatfeet, Metatarsalgia, second metatarsal overload syndrome, Neuromas, Stiff big toe joint, Bunions, Limited big toe motion, Hammertoes, Heel pain, Posterior tibial tendon dysfunction (PTTD), Nerve compressions within the foot/ankle/neuropathy/neuromas, Anterior compartment syndrome, Patello-femoral pain syndrome, Plantar fasciitis, Tarsal tunnel syndrome, Hallux limitus, Hallux rigidus, Hallux valgus, and so forth. The deformities and the symptoms above can be caused by weaknesses in the foot and in the calf muscle.

Presently, known techniques for treatment of the foot deformities include surgical procedures. The known surgical procedures include removal of abnormal bones, removal of bone enlargements, realignment of bones, realignment of cartilagenous surfaces of toe joints and so forth. However, the known surgical procedures give rise to long periods of recovery and a need for patients to wear a cast or surgical boot for weeks following the surgical procedures. Furthermore, the patients are often left with significant scars and poor cosmetics. Finally, the surgical procedures are costly, have a lengthy operating time, and require extensive pre/post-operative care from trained medical staff.

Alternatively, the treatment of the foot deformities may include physical medicine and rehabilitation treatments. Typically, such treatments include use of bunion pads, external splints, and use of exercising devices. However, the physical medicine and rehabilitation treatments are associated with various drawbacks. For example, known foot exercising devices may be designed specifically to target particular joints or muscles of the foot. Moreover, the foot exercising devices may be side specific, i.e. could be used either for a given left foot or for a given right foot.

Therefore, in light of aforementioned problems associated with known approaches for providing treatment for foot deformities, there exists a need to address, for example to overcome, the aforementioned drawbacks associated with the treatment of foot deformities.

SUMMARY

The present disclosure seeks to provide a foot exercising device. Moreover, the present disclosure also seeks to provide a method of, namely a method for, exercising a foot using the exercising device. The present disclosure seeks to provide an at least partial solution to the problems associated with the treatment of foot deformities.

In one aspect, an embodiment of the present disclosure provides a foot exercising device comprising:

a foot support comprising an elevated footrest to support a foot of a person thereon, wherein the elevated footrest forms a positive elevation between a heel and toes of the foot;

a lift wedge to be arranged on the elevated footrest and operable to receive the toes thereon to form a positive elevation between middle foot bones and the toes; and a tilting arrangement comprising a pair of spaced apart fixed plates coupled to the elevated footrest, at least one movable plate hingedly coupled to the fixed plates, a centre plate coupled with the at least one movable plate, the centre plate operable to receive a calf of the person, and a rod pivotally coupled to the centre plate, the rod operable to tilt the centre plate to exert pressure on at least the heel, the middle foot bones and the toes to perform foot correction exercises.

The present disclosure seeks to provide a foot exercising device, for example a non-invasive solution, for treatment of foot deformities and weaknesses. The foot exercising device is easy to operate and designed to target desired joints and/or muscles of the foot. This allows a user to perform effectively foot correction and strengthening exercises using the device of the present disclosure.

Optionally, the foot support of the foot exercising device further comprising a platform coupled to the elevated footrest for supporting the elevated footrest on a floor.

Optionally, the foot exercising device further comprises a detachable angled plate operable to be arranged between the lift wedge and the elevated footrest to form a positive elevation between a medial arch and a lateral arch of the foot of the person. More optionally, the angled plate forms the positive elevation in a range of 4 degrees to 45 degrees.

Optionally, the foot exercising device further comprising a see-saw plate, and a ridge member arranged on the elevated footrest, wherein the ridge member is coupled to a central portion of the see-saw plate to allow the see-saw plate to tilt about the ridge member to form the positive elevation between a medial arch and a lateral arch of the foot of the person.

Optionally, the lift wedge comprises at least one sloped surface.

Optionally, the tilting arrangement comprises a pair of spaced apart movable plates hingedly coupled to the fixed plates.

Optionally, the centre plate comprises a cushion to support the calf of the person.

Optionally the rod is tiltable sideways to optionally the left and to the right to enable the rod to pass the back of the person when tilting the centre plate.

In another aspect, an embodiment of the present disclosure provides a method of, namely a method for, exercising a foot using the aforementioned device, the method comprising:

placing the foot of the person on the elevated footrest forming the positive elevation between the heel and the toes of the foot;

arranging the lift wedge between the elevated footrest and at least one toe of the foot for forming the positive elevation between the middle foot bones and the corresponding toes of the foot;

supporting the calf of the person against the centre plate of the tilting mechanism; and manoeuvring the rod for exerting pressure on at least the heel, the middle foot bones and the toes of the foot to perform foot correction exercises.

Optionally, the method further comprises releasing pressure from at least the heel, the middle foot bones and the toes of the foot by moving away the rod.

Optionally, the method further comprises arranging the detachable angled plate between the lift wedge and the elevated footrest for forming the positive elevation between the medial arch and the lateral arch of the foot of the person.

Optionally, the method further comprises arranging the see-saw plate between the lift wedge and the elevated footrest for forming the positive elevation between the medial arch and the lateral arch of the foot of the person.

Additional aspects, advantages, features and objects of the present disclosure would be made apparent from the drawings and the detailed description of the illustrative embodiments construed in conjunction with the appended claims that follow.

It will be appreciated that features of the present disclosure are susceptible to being combined in various combinations without departing from the scope of the present disclosure as defined by the appended claims.

BRIEF DESCRIPTION OF THE DRAWINGS

The summary above, as well as the following detailed description of illustrative embodiments, is better understood when read in conjunction with the appended drawings. For the purpose of illustrating the present disclosure, exemplary constructions of the disclosure are shown in the drawings. However, the present disclosure is not limited to specific methods and instrumentalities disclosed herein. Moreover, those in the art will understand that the drawings are not to scale. Wherever possible, like elements have been indicated by identical numbers.

Embodiments of the present disclosure will now be described, by way of example only, with reference to the following diagrams wherein.

Figure 1:
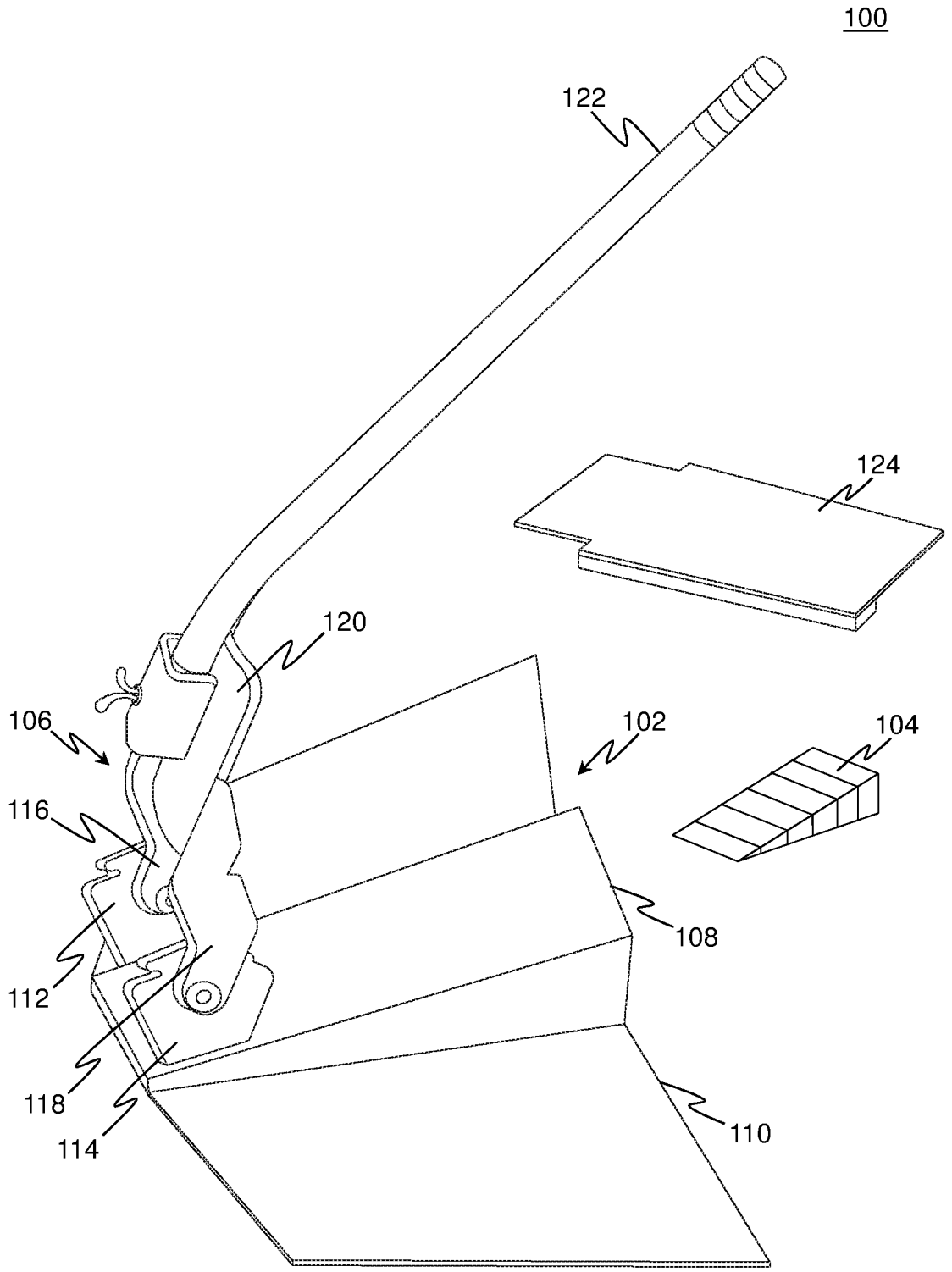
FIG. 1 is a perspective view of a foot exercising device, in accordance with an embodiment of the present disclosure.

In the accompanying drawings, an underlined number is employed to represent an item over which the underlined number is positioned or an item to which the underlined number is adjacent. A non-underlined number relates to an item identified by a line linking the non-underlined number to the item. When a number is non-underlined and accompanied by an associated arrow, the non-underlined number is used to identify a general item at which the arrow is pointing.

DETAILED DESCRIPTION OF EMBODIMENTS

The following detailed description illustrates embodiments of the present disclosure and ways in which they can be implemented. Although some modes of carrying out the present disclosure have been disclosed, those skilled in the art would recognize that other embodiments for carrying out or practicing the present disclosure are also possible.

In one aspect, an embodiment of the present disclosure provides a foot exercising device comprising:

a foot support comprising an elevated footrest to support a foot of a person thereon, wherein the elevated footrest forms a positive elevation between a heel and toes of the foot;

a lift wedge to be arranged on the elevated footrest and operable to receive the toes thereon to form a positive elevation between middle foot bones and the toes; and a tilting arrangement comprising a pair of spaced apart fixed plates coupled to the elevated footrest, at least one apart movable plate hingedly coupled to the fixed plates, a centre plate coupled with the at least one movable plate, the centre plate operable to receive a calf of the person, and a rod pivotally coupled to the centre plate, the rod operable to tilt the centre plate to exert pressure on at least the heel, the middle foot bones and the toes to perform foot correction exercises.

In another aspect, an embodiment of the present disclosure provides a method of, namely a method for, exercising a foot using the device, the method comprising:

placing the foot of the person on the elevated footrest forming the positive elevation between the heel and the toes of the foot;

arranging the lift wedge between the elevated footrest and at least one toe of the foot for forming the positive elevation between the middle foot bones and the corresponding toes of the foot;

supporting the calf of the person against the centre plate of the tilting mechanism; and manoeuvring the rod for exerting pressure on at least the heel, the middle foot bones and the toes of the foot to perform foot correction exercises.

The device is capable of being used as an exercising device, and the method of using the device is a form of exercise.

The foot exercising device comprises a foot support. The foot support comprises an elevated footrest to support a foot of a person thereon. In an embodiment, the foot support may further comprise a platform, for example an extended platform having an extensive floor-contact area, coupled to the elevated footrest for supporting the elevated footrest on a floor.

The elevated footrest forms a positive elevation between a heel and toes of the foot. In an embodiment, the elevated footrest may be a raised and inclined surface to support the foot of the person thereon. Specifically, the elevated foot rest may be a wedge-like structure that is operable to form the positive elevation between the heel and toes of the foot. More specifically, the positive elevation refers to positioning of the toes at a higher level with respect to the heel of the foot on the elevated footrest. It may be evident that dimensions, namely a physical size, of the elevated footrest are suitable to accommodate the foot of the person thereon. In an embodiment, the elevated footrest may be operable to decrease an angle between a leg and foot of the person.

Optionally, the foot support may further comprise the platform, namely the extended platform, coupled to the elevated footrest for supporting the elevated footrest on the floor. Specifically, the extended platform may have a flat, wing-like structure suitable to be placed on the floor. In an embodiment the extended platform may be operable to receive a non-exercising foot of the person thereon. In another embodiment, for a person with stiff legs, the extended platform may be vertically adjustable or may be raised by a separate block on the floor.

The foot exercising device further comprises a lift wedge to be arranged on the elevated footrest. The lift wedge is operable to receive the toes thereon to form a positive elevation between middle foot bones and the toes of the foot. In an embodiment, the lift wedge may be loosely placed and coupled to the detachable angled plate. Specifically, the lift wedge is slidably placed on the detachable angled plate operable to increase an angle between the toe and the elevated footrest.

In one embodiment, the at least one sloped surface of the lift wedge may be made of a soft material. Specifically, the soft material may provide support and/or cushioning to the foot of the person. In an example, the soft material to make the at least one sloped surface of the lift wedge may be fabricated from a flexible polymeric material (for example a polymeric foam or flexible silicone structure), an inflatable weight-bearing arrangement (such an air-pillow arrangement), an assembly of weight-bearing elements that are operable mutually to reconfigure their relative spatial positions for providing support (such as a "bean-bag" type support), a liquid-filled or gel-filled cavity having flexible walls, and so forth. Specifically, the at least one sloped surface of the lift wedge may be coated with cellular rubber (such as neoprene). In an embodiment, the lift wedge may be vertically adjustable. Specifically, the lift wedge may be adjusted vertically to form different positive elevations between middle foot bones and the toes of the foot, according to requirements of the person.

In an embodiment, the lift wedge may be rotatable in operation, and may be coupled to the elevated footrest in operation. Specifically, the lift wedge may be rotated in operation to change a position thereof on the elevated footrest. It may be evident that the rotation of the lift wedge allows treatment of both feet of the person. In an example, a person with foot deformities in both feet may rotate the lift wedge to perform foot correction exercises for each foot.

In an embodiment, the lift wedge comprises at least one sloped surface. The at least one sloped surface is operable to receive the toes of the foot thereon to form a positive elevation between middle foot bones and the toes of foot. Specifically, the positive elevation refers to positioning of the toes at a higher level with respect to the middle foot bone on the elevated foot rest, using the lift wedge.

In an example, the lift wedge has one sloped surface. The lift wedge may be placed under the foot and the toes in a specific manner so that the lift wedge provides a stretching effect to joints between the toes and the middle foot bones by forming the positive elevation thereon. Specifically, the lift wedge may be located between second phalangeal joints of each toe and third phalangeal joints of each toe of the foot of the person. The lift wedge placed in aforementioned position may exert pressure on the third phalangeal joints forming the positive elevation and stretching of muscles connected thereto. In such example, the lift wedge may be aligned with a line through the metatarsophalangeal joint of the toes. A deviation of up to +/−20 degrees from said line through the metatarsophalangeal joint of the toes is acceptable.

In another example, the lift wedge has two sloped surfaces. Specifically, the lift wedge with two sloped surfaces may be used to treat both, a left foot and a right foot of the person without turning the lift wedge. It may be evident that the lift wedge is operable to receive only one foot at a time.

In another example, the lift wedge is placed under at least one toe of the foot. The lift wedge may be operable to increase the angle between the at least one toe and the elevated footrest to maximum mobility of the at least one toe of the person. For example, the maximum mobility of the at least one toe may be up to 90 degrees.

Furthermore, the foot exercising device comprises a tilting arrangement comprising a pair of spaced apart fixed plates coupled to the elevated footrest, at least one movable plate hingedly coupled to the fixed plates, a centre plate coupled with the at least one movable plate and a rod pivotally coupled to the centre plate.

It may be evident that the pair of spaced apart fixed plates supports the at least one movable plate. Furthermore, the at least one movable plate supports the centre plate. In an embodiment, the tilting arrangement may comprise a pair of spaced apart movable plates hingedly coupled to the fixed plates.

The centre plate is operable to receive a calf of the person. In an embodiment, the centre plate may comprise a cushion to support the calf of the person.

Optionally the rod is tiltable sideways to optionally the left and to the right to enable the rod to pass the back of the person when tilting the centre plate.

The rod of the tilting arrangement is operable to tilt the centre plate to exert pressure on at least the heel, the middle foot bones and the toes to perform foot correction exercises. Specifically, the rod may be moved in a manner such that the angle between a leg (or calf) of the person supported by the centre plate, and the foot placed on the elevated footrest, is decreased.

In an embodiment, the foot exercising device may comprise a detachable angled plate operable to be arranged between the lift wedge and the elevated footrest to form a positive elevation between a medial arch and a lateral arch of the foot of the person. Specifically, the detachable angled plate has a wedge like structure of dimensions suitable to fully receive the foot of the person thereon. More specifically, the positive elevation refers to positioning of the medial arch at a higher position with respect to the lateral arch on the detachable angled plate. In an embodiment, the detachable angled plate may form the positive elevation in a range of 4 degrees to 45 degrees. In an example, the detachable angled plate may have triangular cross section.

In an embodiment, the detachable angled plate may be turnable. In an example, the detachable angled plate may be turned through an angle in a range of 140 to 240 degrees, for example substantially 180 degrees, to accommodate the foot of the person thereon. For example, the detachable angled plate may be a pronation plate or a supination plate.

In an embodiment, the detachable angled plate is placed under the foot in a manner such that the detachable angled plate may exert pressure on a lower leg, the heel, the middle foot bones of the foot and muscle groups connected thereto. Specifically, the pressure may be exerted by forming the positive elevation between a medial arch and a lateral arch of the foot of the person.

In an embodiment, the foot exercising device may comprise a see-saw plate and a ridge member arranged on the elevated footrest. The ridge member is coupled to a central portion of the see-saw plate allowing the see-saw plate to tilt about the ridge member to form the positive elevation between a medial arch and a lateral arch of the foot of the person. Specifically, the see-saw plate may be used to treat both, a left foot and a right foot of the person without turning the lift wedge. It may be evident that the see-saw plate is operable to receive only one foot at a time.

In operation, the foot exercising device of the present disclosure may be used for exercising the foot of the person. The foot of the person may be placed on the elevated footrest to form the positive elevation between the heel and the toes of the foot. Thereafter, the lift wedge may be arranged between the elevated footrest and the at least one toe of the foot for forming the positive elevation between the at least one middle foot bone and the corresponding toe of the foot. In an embodiment, the detachable angled plate may be arranged between the lift wedge and the elevated footrest to form the positive elevation between the medial arch and the lateral arch of the foot of the person. In another embodiment, the see-saw plate may be arranged between the lift wedge and the elevated footrest for forming the positive elevation between the medial arch and the lateral arch of the foot of the person. The calf of the person may be supported against the centre plate of the tilting mechanism, and the rod may be manoeuvred to exert pressure on at least the heel, the middle foot bones and the toes to perform foot correction and strengthening exercises. In an embodiment, exercising the foot further comprises releasing pressure from at least the heel, the middle foot bones and the toes of the foot by moving away the rod.

In an embodiment, the exertion and release of pressure on at least the heel, the middle foot bones and the toes of the foot by moving the rod may be performed alternately for pre-determined time periods. In an example, the pre-determined time period may be in a range of 1 to 3 minutes each, for example 2 minutes each, for exerting and releasing pressure.

In an embodiment, the foot of the person may be placed on the elevated footrest in a specific manner such that the positive elevation is formed between the heel and the toes. Such positioning of the heel may provide a stretching effect to the heel, the lower leg, the middle foot bones, and muscles related thereto. Moreover, arranging the lift wedge between the toes and the elevated foot rest may provide a stretching effect to the middle foot bones, the toes and muscles related thereto. In an embodiment, arranging the detachable angled plate between the lift wedge and the elevated footrest may provide a decreased strain in the plantar aponeurosis.

In an embodiment, pressure on at least the heel, the lower leg, the calf, the middle foot bones, the toes, the medial arch, the lateral arch and the muscles related thereto, may be exerted by manoeuvring the rod of the tilting arrangement. In an example, the manoeuvring the rod may lead to exerting pressure on the lower leg by decreasing the angle between the leg (or calf) and the foot.

In an embodiment, the rod may be manoeuvred by the person for exerting the pressure on the lower leg. In another embodiment, the rod may be manoeuvred by a medical staff for exerting the pressure on the lower leg.

In an embodiment, pressure on the lower leg may be exerted by moving a knee of the person in a specific manner so that the angle between the leg (or calf) and the foot of the persona may be decreased.

In an embodiment, the non-exercising foot of the person may be operable to release pressure exerted to at least the heel, the lower leg, the calf, the middle foot bones, the toes, the medial arch, the lateral arch and the muscles related thereto. Specifically, the non-exercising foot may be moved to a forward position (or bent) for releasing the pressure exerted on the lower leg.

The present disclosure thus provides a foot exercising device and a method for exercising a foot using the device. The foot exercising device is easy to install in limited space and is easy to operate. Furthermore, the device and method of, namely method for, exercising the foot provides a non-invasive solution for treatment of foot deformities, thereby reducing high costs associated with surgery and the need for extensive pre/post-operative care. Moreover, the described device and method and system may be used to treat both left foot and right foot of the person in a safe manner to minimise risk of injury to the person. Additionally, the device and method are designed to target desired joints and/or muscles of the foot, which allows a user to efficiently perform foot correction exercises.

When stretching the calf muscles, there are often no effect even if a great force is applied when dorsalflexing in the ankle. The reason is that there is a stress applied to the arch during the stretch. The calf muscles react negatively on that and get tensed as a protection.

To get effect of the stretching you have to stabilize the lateral arch. It has to be protected from the natural stress impact when you attempt to bend to the maximum in the ankle.

This is done through stabilization of the lateral arch of the foot.

By placing a wedge, which lifts the metatarsophalangeal joints 4-5, there will be a tension in the plantar fascia and the structures attached between the toes and the heel bone (calcaneus). A tension of these structures get the bones/joints in the foot "linked" together to form a stable unit.

When stretching in this position there will be a stability in the foot that allow the calf and foot muscles to relax, wherein the muscles can relax during the exercise.

When dorsal flexing the foot, the peroneus longus tendon will, when passing over the cuboid in the peroneal groove, enhance the locking effect of the cuboid into its locking position.

DETAILED DESCRIPTION OF THE DRAWINGS

Referring to FIG. 1, there is shown an illustration of a perspective view of a foot exercising device 100, in accordance with an embodiment of the present disclosure. The foot exercising device 100 comprises a foot support 102, a lift wedge 104, and a tilting arrangement 106. As shown, the foot support 102 comprises an elevated footrest 108 and a platform 110, for example implemented as an extended platform having an extensive floor-contact area for spreading weight on the floor-contact area when in operation. The elevated footrest 108 supports a foot of a person thereon, and the platform 110 is coupled to the elevated footrest 108 for supporting the elevated footrest 108 on a floor. The elevated footrest 108 is operable to form a positive elevation between a heel and toes of the foot. The lift wedge 104 to be arranged on the elevated footrest 108, is operable to receive the toes thereon to form a positive elevation between middle foot bones and the toes. As shown, the tilting arrangement 106 includes a pair of spaced apart fixed plates 112 and 114 coupled to the elevated footrest 108, a pair of spaced apart movable plates 116 and 118 hingedly coupled to the fixed plates 112 and 114, a centre plate 120 arranged between the pair of spaced apart movable plates 116 and 118, and a rod 122, pivotally coupled to the centre plate 120. The centre plate 120 is operable to receive a calf of the person. The rod 122 is operable to tilt the centre plate 120 to exert pressure on at least the heel, the middle foot bones and the toes to perform foot correction exercises. Optionally the rod is also tiltable sideways optionally to the left and to the right to enable the rod to pass the back of the person when tilting the centre plate. Optionally, the foot exercising device 100 may also comprise a detachable angled plate 124, as shown. The detachable angled plate 124 may be arranged between the lift wedge 104 and the elevated footrest 108 to form a positive elevation between a medial arch and a lateral arch of the foot of the person.

Figure 2:
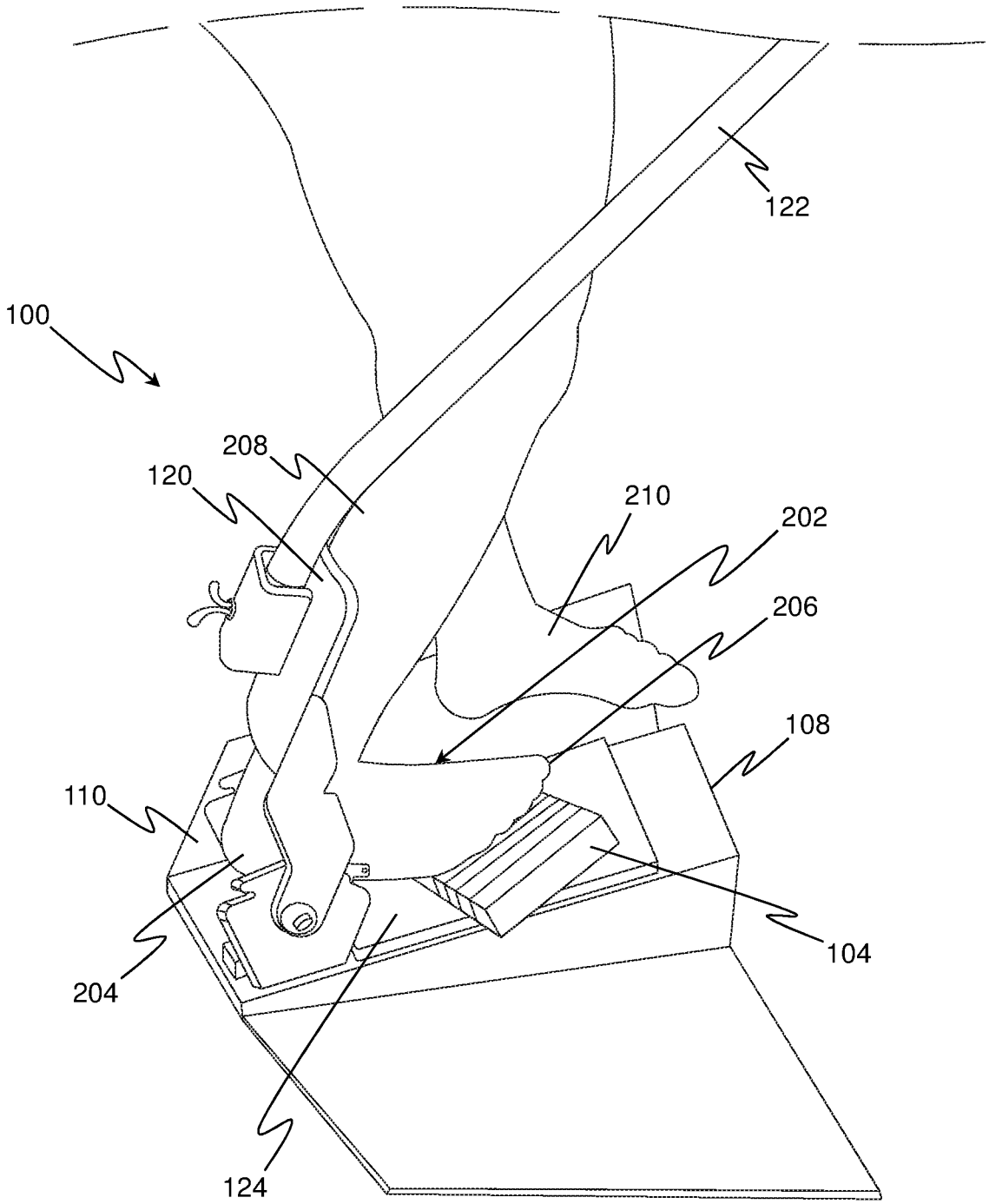
FIGS. 2 and 3 are perspective views of the foot exercising device of FIG. 1 in a used state, in accordance with an embodiment of the present disclosure.
Figure 3:
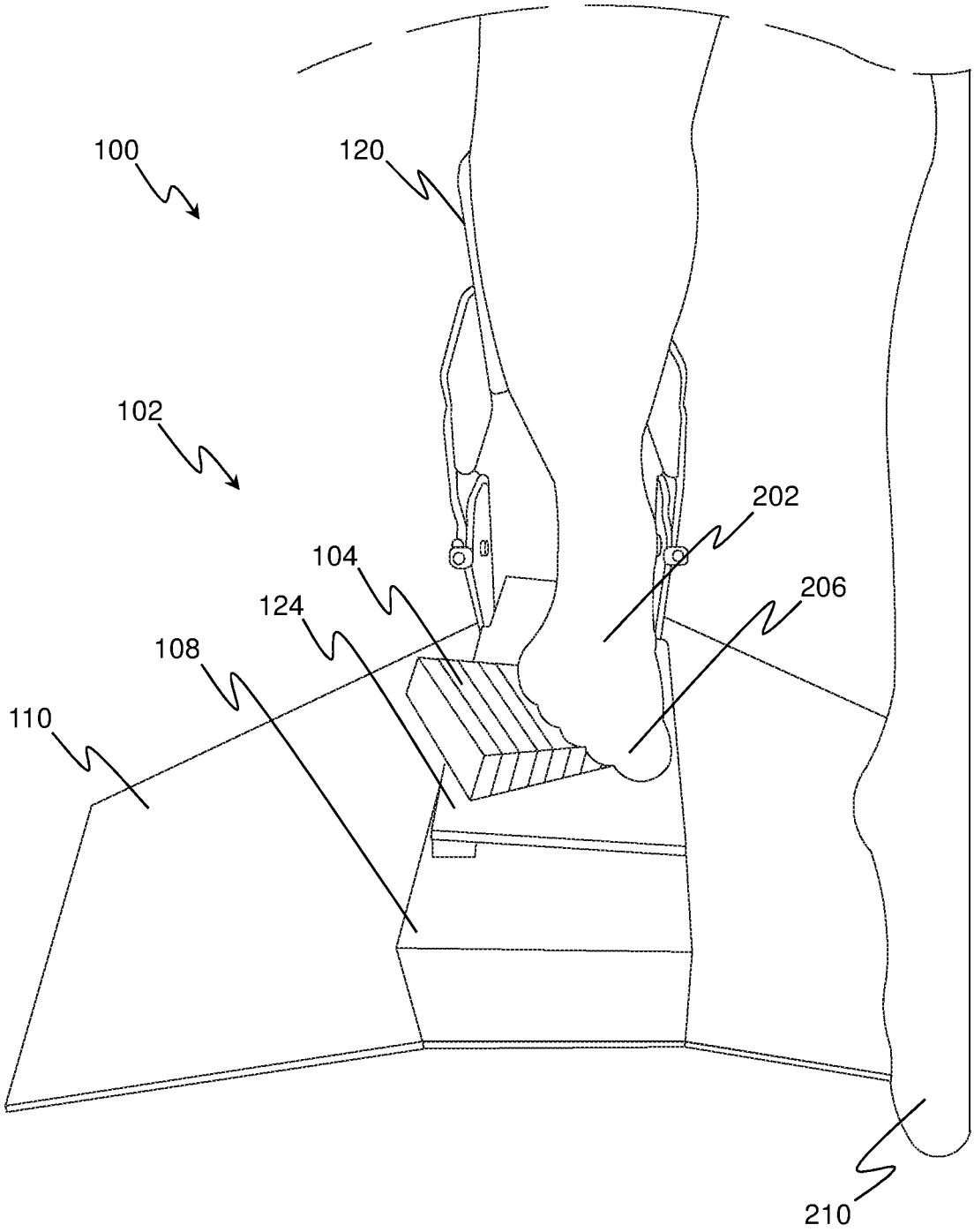

Referring to FIGS. 2 and 3, there are shown illustrations of perspective views of the foot exercising device 100 of FIG. 1 in a used state, in accordance with an embodiment of the present disclosure. Specifically, in the FIGS. 2 and 3, there are shown illustrations of side and front perspective views, respectively, of the foot exercising device 100 in the used state. As shown, a foot 202 of a person is supported on the elevated footrest 108 to form a positive elevation between a heel 204 and toes 206 of the foot 202. The lift wedge 104 (arranged on the elevated footrest 108) receives the toes 206 thereon to form a positive elevation between middle foot bones and the toes 206. Moreover, the detachable angled plate 124 is arranged between the lift wedge 104 and the elevated footrest 108 to form a positive elevation between a medial arch and a lateral arch of the foot 202 of the person. In an example, the detachable angled plate 124 forms the positive elevation in a range of 8 degrees to 45 degrees 4*o* to 45*o*). As shown, the centre plate 120 receives a calf 208 of the person. The rod 122 is operable to tilt the centre plate 120 to exert pressure on at least the heel 204, the middle foot bones, and the toes 206 to perform foot correction exercises. As shown, a non-exercising foot 210 of the person is received on the platform 110.

Figure 4:
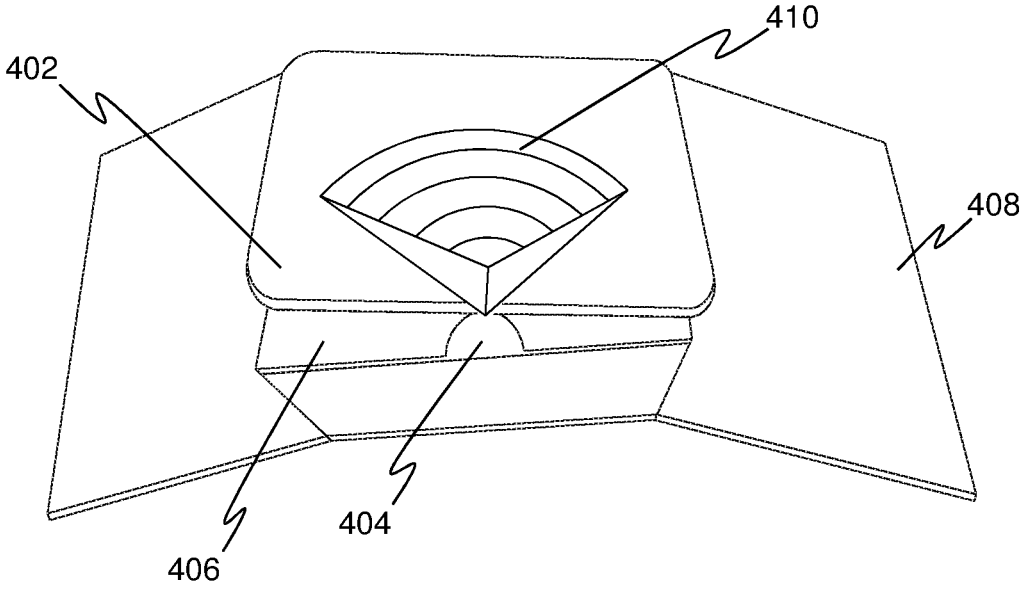
FIG. 4 is a perspective view of a foot exercising device, in accordance with another embodiment of the present disclosure.

Referring to FIG. 4, there are shown illustrations of a perspective view of a foot exercising device 4, in accordance with another embodiment of the present disclosure. The foot exercising device is structurally and functionally similar to the foot exercising device 100, explained in conjunction with FIGS. 1 to 3. However, as shown, the foot exercising device includes a see-saw plate 402 and a ridge member 404. The ridge member 404 is arranged on an elevated footrest 406. Furthermore, the ridge member 404 is coupled to a central portion of the see-saw plate 402 to allow the see-saw plate 402 to tilt about the ridge member 404 to form the positive elevation between a medial arch and a lateral arch of a foot of the person. An platform 408, for example an extended platform having an extensive floor-contact area, is coupled to the elevated footrest 406. As shown, a lift wedge 410 comprising two sloped surfaces is arranged on top of the see-saw plate 402. The lift wedge 410 is operable to receive toes of the foot thereon to form a positive elevation between middle foot bones and the toes. It may be evident that the foot exercising device may also include a tilting arrangement (not shown).

Figure 5:
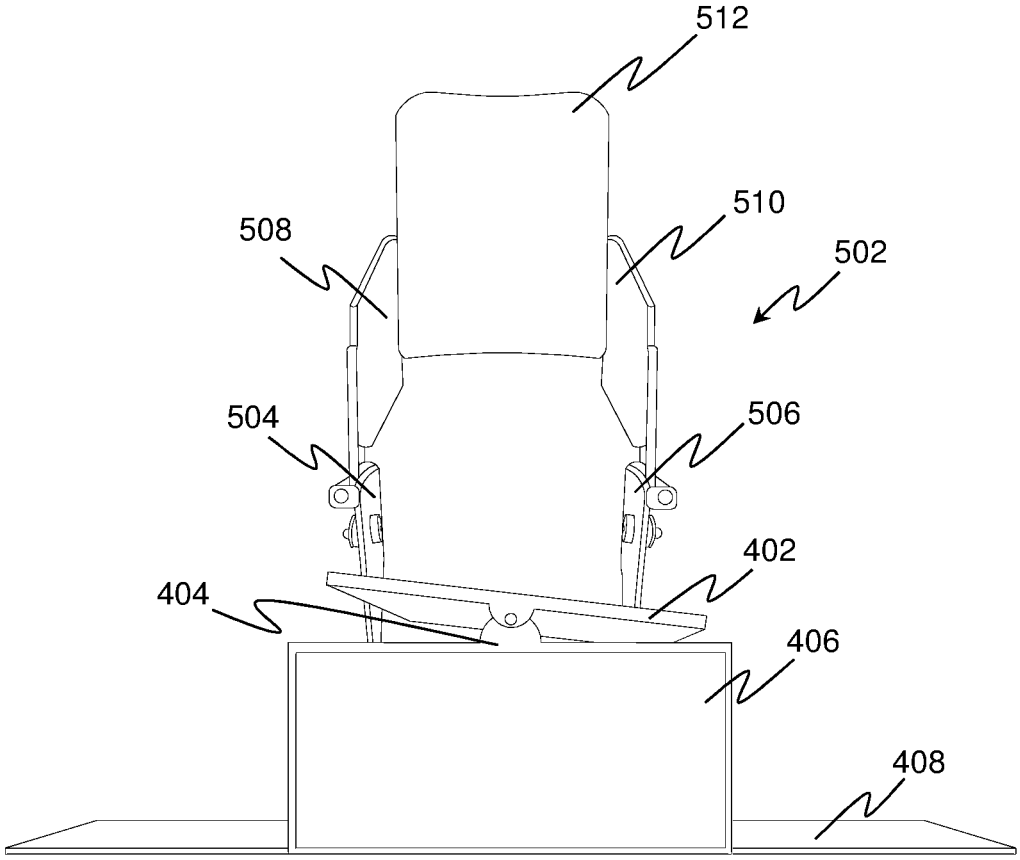
FIG. 5 is a front view of the foot exercising device of FIG. 4, in accordance with an embodiment of the present disclosure.

Referring to FIG. 5, there is shown an illustration of a front view of the foot exercising device of FIG. 4, in accordance with an embodiment of the present disclosure. As shown, the ridge member 404 is arranged on the elevated footrest 406. The ridge member 404 is coupled to a central portion of the see-saw plate 402 to allow the see-saw plate 402 to tilt about the ridge member 404. A lift wedge (not shown) may be arranged on top of the see-saw plate 402. The foot exercising device also includes a tilting arrangement 502 including a pair of spaced apart fixed plates 504 and 506 coupled to the elevated footrest 406, a pair of spaced apart movable plates 508 and 510 hingedly coupled to the fixed plates 504 and 506, a centre plate 512 arranged between the pair of spaced apart movable plates 508 and 510, and a rod (not shown), pivotally coupled to the centre plate 512.

Figure 6:
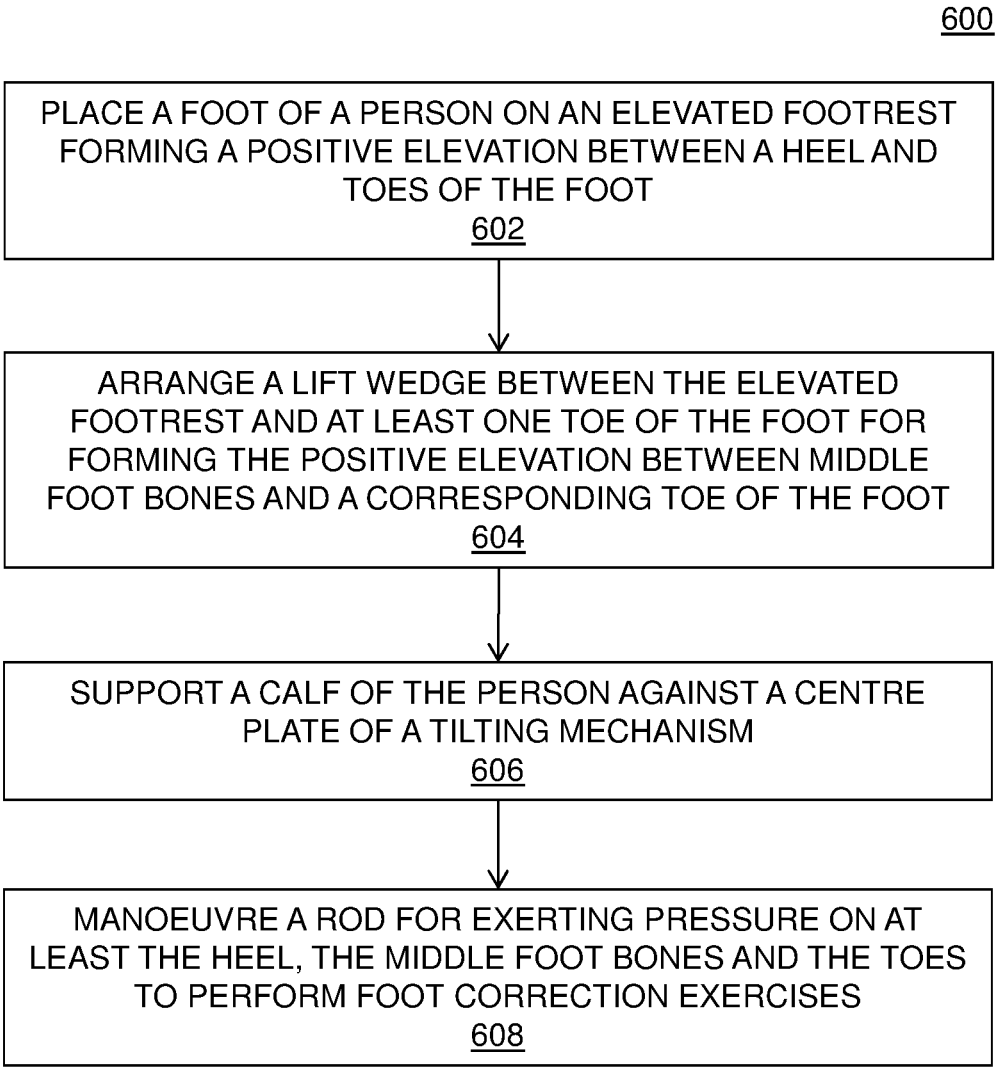
FIG. 6 illustrates steps of a method for exercising a foot using the foot exercising device, in accordance with an embodiment of the present disclosure.

Referring to FIG. 6, illustrated are steps of a method 600 for exercising a foot using the foot exercising device (such as the foot exercising devices 100 of FIGS. 1 to 5), in accordance with an embodiment of the present disclosure. At step 602, a foot of a person is placed on an elevated footrest forming a positive elevation between a heel and toes of the foot. At step 604, a lift wedge is arranged between the elevated footrest and at least one toe of the foot for forming the positive elevation between middle foot bones and a corresponding toe of the foot. At step 606, a calf of the person is supported against a centre plate of a tilting mechanism. At step 608, a rod is manoeuvred for exerting pressure on at least the heel, the middle foot bones and the toes to perform foot correction exercises.

The steps 602 to 608 are only illustrative and other alternatives can also be provided where one or more steps are added, one or more steps are removed, or one or more steps are provided in a different sequence without departing from the scope of the claims herein. For example, the method 600 may comprise releasing pressure from at least the heel, the middle foot bones and the toes of the foot by moving away the rod. Further, the method 600 may comprise arranging a detachable angled plate between the lift wedge and the elevated footrest for forming the positive elevation between the medial arch and the lateral arch of the foot of the person. Optionally, the method 600 may comprise arranging a see-saw plate between the lift wedge and the elevated footrest for forming the positive elevation between the medial arch and the lateral arch of the foot of the person.

According to the described method a person to exercise or to be treated could be in a sitting or in a standing position, wherein the exercise or the treatment of the foot can be performed with the knee in a bent and in an extended position.

When the person is in a sitting position with the knee bent the pressure on the sole of the foot are resisted by a counterhold above the knee. In a sitting position with the knees extended the pressure on the sole of the foot is resisted by the lower back and the pelvis.

Modifications to embodiments of the present disclosure described in the foregoing are possible without departing from the scope of the present disclosure as defined by the accompanying claims. Expressions such as "including", "comprising", "incorporating", "have", "is" used to describe and claim the present disclosure are intended to be construed in a non-exclusive manner, namely allowing for items, components or elements not explicitly described also to be present. Reference to the singular is also to be construed to relate to the plural.

The invention claimed is:

1. A foot exercising device for exerting pressure on at least a heel, middle foot bones and toes, comprising:

a foot support comprising an elevated footrest to support a foot of a person thereon, wherein the elevated footrest forms a positive elevation between a heel and toes of the foot;

a lift wedge to be arranged on the elevated footrest and operable to receive at least one toe thereon to form a positive elevation between middle foot bones and the corresponding toes of the foot; and a tilting arrangement comprising a pair of spaced apart fixed plates coupled to the elevated footrest;

at least one movable plate hingedly coupled to the fixed plates;

a centre plate coupled with the at least one movable plate, the centre plate operable to receive a calf of the person, and a rod pivotally coupled to the centre plate, the rod operable to tilt the centre plate to exert pressure on at least the heel, the middle foot bones and the toes to perform foot correction exercises.

2. A foot exercising device according to claim 1, wherein the lift wedge is rotable in operation to change a position thereof on the elevated footrest.

3. A foot exercising device according to claim 1, wherein the foot support further comprising a platform coupled to the elevated footrest for supporting the elevated footrest on a floor.

4. A foot exercising device according to claim 1, further comprising a detachable angled plate operable to be arranged between the lift wedge and the elevated footrest to form a positive elevation between a medial arch and a lateral arch of the foot of the person.

5. A foot exercising device according to claim 4, wherein the detachable angled plate forms the positive elevation in a range of 4 degrees to 45 degrees.

6. A foot exercising device according to claim 1, further comprising, a see-saw plate, and a ridge member arranged on the elevated footrest, wherein the ridge member is coupled to a central portion of the see-saw plate to allow the see-saw plate to tilt about the ridge member to form the positive elevation between the medial arch and the lateral arch of the foot of the person.

7. A foot exercising device according to claim 1, wherein the lift wedge comprises at least one sloped surface.

8. A foot exercising device according to claim 1, wherein the tilting arrangement comprises a pair of spaced apart movable plates hingedly coupled to the fixed plates.

9. A foot exercising device according to claim 1, wherein the centre plate comprises a cushion to support the calf of the person.

10. A foot exercising device according to claim 1, wherein the rod is tiltable sideways optionally to the left and to the right to enable the rod to pass the back of the person when tilting the centre plate.

11. A method of exercising a foot using the device according to claim 1, the method comprising:

placing the foot of the person on the elevated footrest forming the positive elevation between the heel and the toes of the foot;

arranging the lift wedge between the elevated footrest and at least one toe of the foot for forming the positive elevation between the middle foot bones and the corresponding toes of the foot;

supporting the calf of the person against the centre plate of the tilting mechanism; and manoeuvring the rod for exerting pressure on at least the heel, the middle foot bones and the toes of the foot to perform foot correction exercises.

12. A method according to claim 11, wherein the method further comprises releasing pressure from at least the heel, the middle foot bones and the toes of the foot by moving away the rod.

13. A method according to claim 11, wherein the method further comprises arranging the detachable angled plate between the lift wedge and the elevated footrest for forming the positive elevation between the medial arch and the lateral arch of the foot of the person.

14. A method according to claim 11, wherein the method further comprises arranging the see-saw plate between the lift wedge and the elevated footrest for forming the positive elevation between the medial arch and the lateral arch of the foot of the person.

* * * * *